United States Patent [19]

Kochte et al.

[11] Patent Number: 4,554,702

[45] Date of Patent: Nov. 26, 1985

[54] VACUUM DRIVEN TOOL

[75] Inventors: Werner W. Kochte, Ravenna; Susan K. Nimon, Cuyahoga Falls, both of Ohio

[73] Assignee: The Scott & Fetzer Company, Twinsburg, Ohio

[21] Appl. No.: 639,956

[22] Filed: Aug. 10, 1984

[51] Int. Cl.[4] ..... A47L 9/04

[52] U.S. Cl. ..... 15/372; 15/385; 15/387

[58] Field of Search ..... 15/387, 372, 371, 385

[56] References Cited

U.S. PATENT DOCUMENTS

| | | | |
|---|---|---|---|
| 2,078,634 | 4/1937 | Karlström | 15/387 X |
| 2,477,681 | 8/1949 | Anderson | 15/387 X |
| 2,703,904 | 3/1955 | De Long | 15/372 |
| 3,909,875 | 10/1975 | Rother et al. | 15/387 |
| 3,959,848 | 6/1976 | Rother | 15/372 |

*Primary Examiner*—Chris K. Moore

*Attorney, Agent, or Firm*—Pearne, Gordon, Sessions, McCoy, Granger & Tilberry

[57] ABSTRACT

A rotary brush vacuum sweeper having a directly coupled disc brush and turbine wheel. The disc brush floats axially within the sweeper housing to control brush force and is in telescopic relation with rearward motor components to promote favorable air flow characteristics. Hollow space between the disc brush and turbine wheel is continuously purged of dirt and debris by ambient air passing through an associated internal circuit.

8 Claims, 6 Drawing Figures

VACUUM DRIVEN TOOL

BACKGROUND OF THE INVENTION

The invention relates to rotary air driven tools and, in particular, to improvements in portable hand-carried vacuum brush sweepers.

PRIOR ART

Hand-carried power-operated cleaning implements especially suited for cleaning upholstery, stair cases, automotive interiors, garments and the like have been developed. Certain types of these implements rely on a remote vacuum source such as a conventional upright residential vacuum cleaner appliance for their power. Air flow established through a flexible hose interconnecting this vacuum cleaner appliance and the hand-carried implement is utilized to derive power for operating the implement brush. At the same time, such air flow is effective to collect dirt and debris loosened by such air flow and/or brush action. Known types of hand-carried vacuum brush sweepers include units with a vacuum air driven motor operating a rotary brush through a drive train such as a belt and pulley system. Because of their inherent complexity, such units can be relatively expensive to manufacture, bulky and cumbersome to use. Another known type of vacuum sweeper are those in which a turbine is directly connected to a rotary brush element. Frequently, this type of unit develops relatively low brush sweeping power. Where a sweeper unit is provided with a resiliently floating brush, additional problems may be encountered in protecting internal elements of the brush or turbine motor from accumulations of dirt and debris.

SUMMARY OF THE INVENTION

The invention provides a hand-carried vacuum sweeper that combines the features of a direct drive between an air turbine and a rotary disc brush, floating disc brush mount, high brush power level, and self-cleaning action for purging the interior parts of the brush and turbine of accumulations of dirt and debris.

In the disclosed embodiment, the disc brush is driven by an impulse turbine air motor which adopts the principles of the Pelton wheel. Air is directed to the blades of a turbine wheel by a stator having a blade configuration that increases motor torque at relatively low rotational speeds. The stator cooperates with a fixed bearing in the sweeper housing to support a common shaft for the turbine wheel and disc brush. The shaft is self-aligning with the fixed housing bearing and permits the turbine wheel, stator and disc brush to be removed as a center assembly from the housing for inspection and cleaning.

The disc brush floats axially relative to the housing to control and limit brushing force. The disc brush is in telescopic relation to rearward elements of the center assembly to maintain favorable air flow characteristics and high turbine efficiency.

An air flow circuit is provided for purging an interior hollow space of the center assembly of accumulations of dirt and debris and thereby protect the bearing and spring elements disposed in this space. The purge circuit develops a positive flow of ambient air through this hollow space which is effective to blow or otherwise clear it of such dirt and debris.

DESCRIPTION OF THE PREFERRED EMBODIMENT

Figure 1:
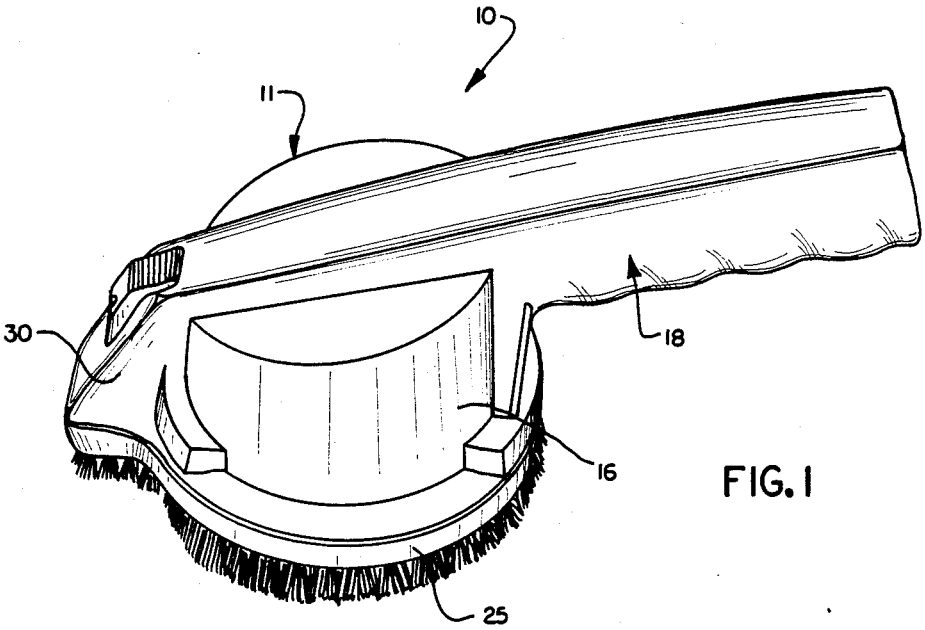
FIG. 1 is a perspective view of the upper side of a vacuum air driven brush sweeper tool constructed in accordance with the invention.

Referring now to the drawings, there is shown a vacuum powered device 10 in the form of a combined rotary brush and vacuum nozzle cleaning tool. The major parts of the illustrated tool 10 comprise a housing 11 and a center assembly 12 received within the housing. The center assembly 12, in turn, has as its principle parts a rotary disc brush 13, a stator 14 and a turbine wheel 15.

The housing 11 is preferably formed of injection molded plastic components. A main body part 16 of the housing 11 is a hollow member having a generally cup shaped portion 17 and inclined tubular handle portion 18. As illustrated most clearly in FIG. 5, the interior space of the cup and handle portions 17, 18 communicate directly where the handle portion generally merges with an inclined end wall 19 of the cup portion and a generally cylindrical sidewall 20 of the cup-shaped portion.

A brush ring unit 25 forms a forward part of the housing 11. The brush ring unit 25 is releasably retained in position against a forward face 26 of the main housing body cup portion 17 by a hook 27 integral with the ring 25 and a diametrically opposed pin 28 which snaps into a spring steel clothespin-type catch 29 anchored in a hollow projection 30 of the main housing body 16. The brush ring 25 is released from the main housing body 16 by depressing a release button 31 carried in the projection 30. The release button 31 includes an operating pin 32 which is adapted to press the opposed ring pin 28 out of the spring catch 29.

Figure 5:
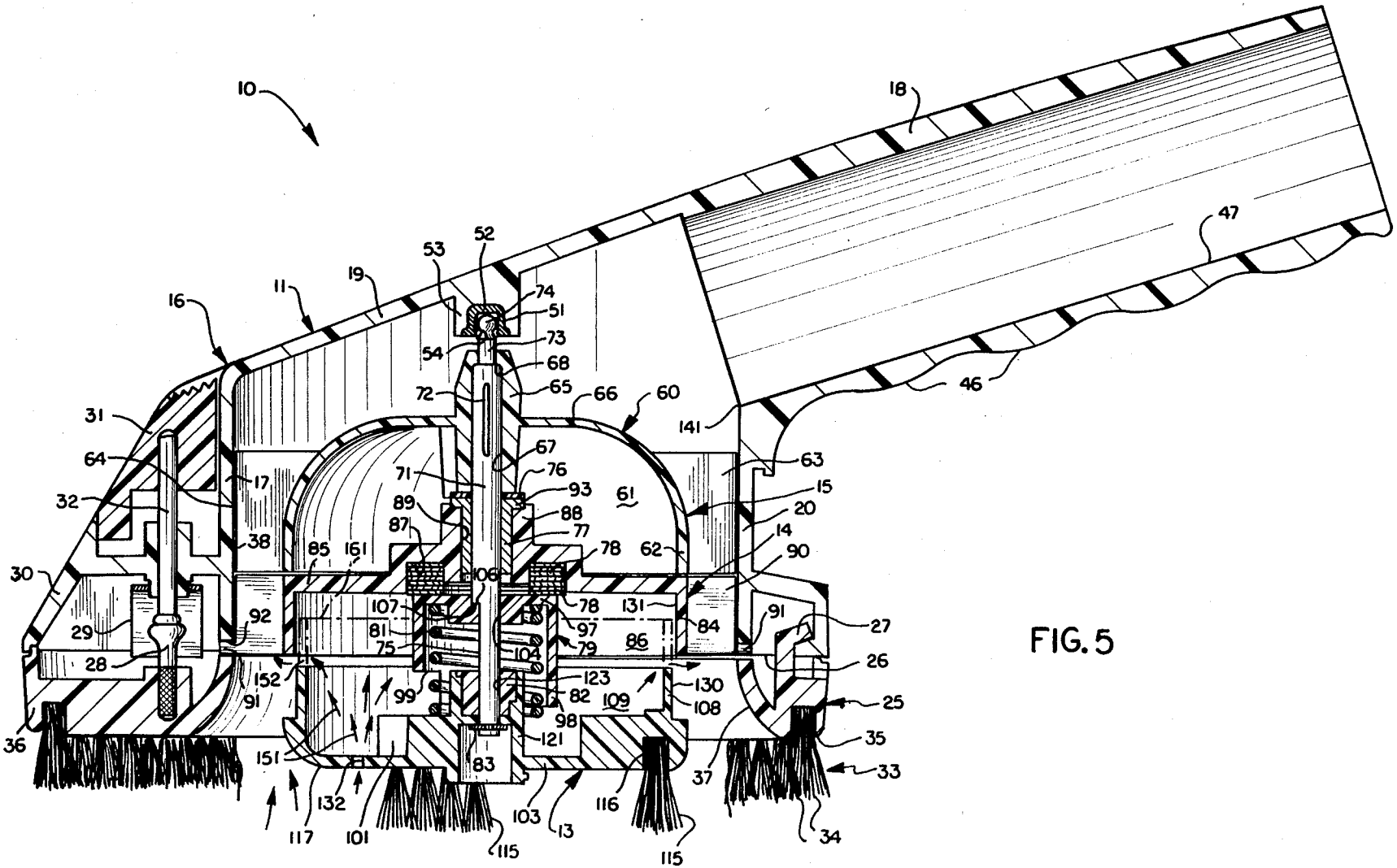
FIG. 5 is a cross sectional view of the tool taken in a plane through the axis of the center assembly.

Brush tufts 33 each formed of a plurality of bristles 34 are pressed into associated holes, in a known manner, across a forward face 35 of the ring 25 and an integral projection 36. Radially inward of the brush tufts 33, the ring 25 is formed with an annular bellmouthed surface 37 which forms an inlet for air to be drawn through the housing 11. The ring 25, preferably, is injection molded of polypropylene or other known plastic material suitable for receiving the brush tufts 33 under pressure without significant distortion or damage. As indicated in FIG. 5, the bellmouthed surface 37 merges smoothly with an annular interior surface 38 formed by the main housing body cup portion 17. This annular interior housing surface 38, along the axial zone subtended by the center assembly 12, has the general configuration of a shallow cone and but for a draft angle, is nearly cylindrical.

The tubular handle portion 18 of the main housing body 16 preferably has a series of gently formed exterior ribs 46 on its forward side to provide a comfortable finger grip zone. The handle portion 18 is grasped in the hand of the user to permit the tool 10 to be conveniently hand-carried and manipulated. The interior, designated 47 of the tubular handle portion 18, ideally, is in the form of a shallow cone or taper to provide a friction lock fit with a mating tubular end fitting of a flexible vacuum hose, as is customary in the domestic vacuum cleaner industry. An oil impregnated bronze bushing 51, having a cup shape with a blind end 52 is press fitted or otherwise retained in the hollow of a boss 53 formed on the housing end wall 19. The bushing or bearing 51 has a central blind bore 54 aligned with the axis of the interior conical or annular housing surface 38.

Figure 4:
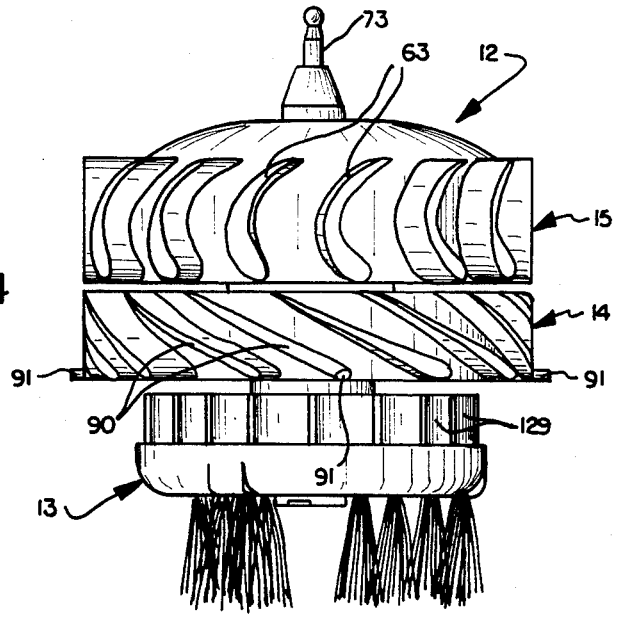
FIG. 4 is a side view of the center assembly.

The turbine wheel 15 includes a hemi-spheroidal shell or cup portion 60 such that it forms a hollow space 61. On a sidewall area 62 of the hemi-spheroidal part 60 of the turbine wheel 15, there are intergrally formed a plurality of peripherally spaced turbine blades 63. The turbine blades 63 have a configuration which takes advantage of the principles of the Pelton wheel. The blades 63 (FIG. 4) can each be described generally as a curved plane of changing radius having its imaginary axii extending radially of the turbine wheel axis i.e. the axis of revolution of the hemi-spheroidal portion 60. In the illustrated case, the turbine blades 63 extend radially from the wheel sidewall 62 almost to the interior housing surface 38, but for a limited amount of radial clearance as indicated at 64. Aligned with the axis of the turbine wheel 15 is a hub portion 65 integrally formed with an end wall 66 of the hemi-spheroidal portion 60. The hub portion 65 has a central cylindrical bore 67. The bore 67 is stepped with a generally radial shoulder 68. The turbine wheel 15 is preferably injection molded of ABS or other suitable rigid plastic. A cylindrical steel shaft 71 is permanently assembled to the turbine wheel 15 by press fitting it into the bore 67. Ribs 72 formed as upsets on the shaft 71, or otherwise, rotationally lock the shaft and wheel 15 together. A rearward end 73 of the shaft 71 protrudes from the hub portion 65 and includes a spherical area 74. The spherical shaft end area 74 is received in the bushing bore 54 so that the bushing 51 serves as a radial and end thrust bearing for the shaft end 73. The spherical shaft end 74 permits the shaft 71 to be self-aligning to the bushing 51. At its opposite end, the shaft 71 has an elongated flat 75.

Assembled in succession on the shaft 71 are a thrust washer 76, a bushing 77 carried in the stator 14, a felt washer 78, a spring cup shield 79, a spring 81, an insert 82 in the disc brush 13 and a retaining washer 83. The thrust washer 76 is formed of acetal or other low friction, low noise material and eliminates wear between the wheel hub portion 65 and bushing 77.

The stator 14 in its illustrated form includes a shallow cup or pan-shaped body having a generally cylindrical sidewall 84 and a generally radial end wall 85. The sidewall 84 and end wall 85 bound a hollow space 86. The end wall 85 is stepped axially at 87 to form a recess for reception of the felt washer 78. Integrally formed with the end wall 85 is a hub 88 which is coaxial with the sidewall 84. The bronze bushing or bearing 77 is press fitted in a central cylindrical bore 89 of the stator hub 88. The bearing 77 is of the oil impregnated type. Integrally formed on the periphery of the stator sidewall 84 are a plurality of spaced stator blades 90. Each blade 90 (FIG. 4) lies in a generally flat plane that is both radial and inclined with respect to the axis of the center assembly 12, i.e. the axis of the shaft 71. The blades 90 are effective to direct air passing through the housing 11 towards the turbine wheel blades 63 at an angle which, in conjunction with the configuration of such turbine wheel blades, increases torque at relatively low rotational speeds. As indicated, the stator blades 90 extend radially from the stator sidewall 84 to the housing surface 38 with minimal clearance. The stator 14 is locked in position against rotation in the housing 11 by spider legs 91 which in the illustrated case are four in number and are at 90° intervals on the periphery of the stator. The spider legs 91 are received with a friction fit in associated cavities 92 formed in the main housing body forward face 26. The spiders 91 are locked in their respective cavities 92 or released therefrom by installation or removal of the brush ring unit 25. In its installed position, the brush ring unit 25 bears against the forwardmost surfaces of the spiders 91 to retain them in the cavities 92. Removal of the brush ring unit 25 from the main housing body 16 releases the spider legs 91 and permits the center assembly 12 to be removed from the housing for inspection and/or cleaning.

It will be understood that with the stator 14 locked in position in the main housing body 16 by virtue of the spider legs 91 being received in the associated cavitites 92, the stator bearing or bushing 77 is spatially fixed in relation to the housing 11. The bearing 77 thus cooperates with the cup bushing 51 to rigidly support the shaft 71 in the housing 11. Endwise motion of the shaft 71 is limited by the cup bushing 51 and a shoulder or flange portion 93 of a bushing 77 which operates through the thrust washer 76 to restrict axial motion of the turbine wheel hub portion 65 to which the shaft is fixed as aforementioned.

The spring cup shield 79 has a generally cylindrical sidewall 98 and a circular end wall 97. The free end of the sidewall 98 is notched at three uniformly spaced angular zones 99 which provide clearance for three corresponding ribs 101 formed on a rear face 102 of an end wall 103 of the rotary disc brush 13. The cup shield end wall 97 has a central aperture 104 of D-shape which rotationally interlocks with the flat 75 of the shaft 71. Rearward thrust loads on the spring shield 79 are transmitted to the shaft 71 by virtue of abutment of radial faces 106, 107 of the cup shield and shaft respectively. The spring cup shield 79 reduces the risk of threads, string and like filaments from being wrapped around the shaft 71 and the spring 81. Alternative constructions for the shield 79 include cages or spider legs as substitutes for the notched sidewall 98.

Figure 6:
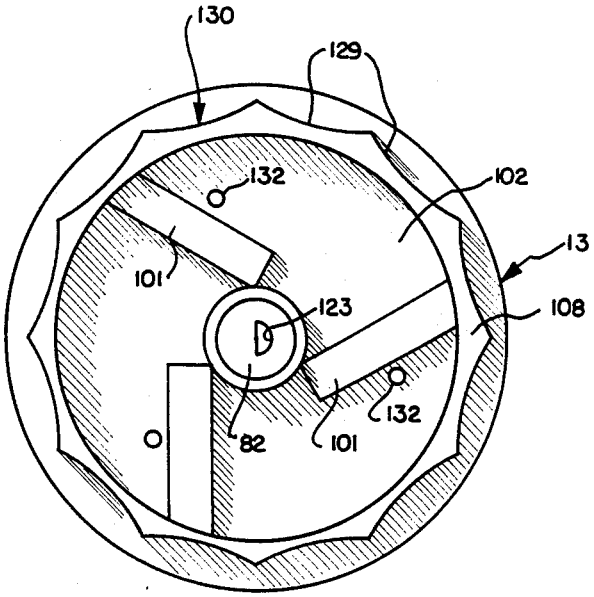
FIG. 6 is an end view of a rear face of the rotary disc brush.

The end wall 103 and an annular sidewall 108 of the rotary disc brush 13 form a hollow space 109. An exterior surface 130 of the brush sidewall 108 varies in radial spacing from the rotational axis of the brush 13. As shown, this surface 130 is a composite of a plurality of reverse cylindrical segment 129, angularly spaced about the outer periphery of the sidewall 108. The end view of the rear face of the disc brush 13 illustrated in FIG. 6 shows these cylindrical surface segments 129 as scallops.

In the illustrated case, the rotary disc brush 13 has a set of three rows 114 of brush tufts 115 which are formed of individual bristles that are pressed into corresponding holes 116. Like the brush ring 25, the disc brush 13 is preferably injection molded of polypropylene or other suitable plastic which accepts the force fitting of the brush tufts 115 without significant distortion or detrimental effects to the appearance of this part. The brush tuft 114 rows on a forward face 117 of the disc brush 13 are arranged in an offset Y pattern. The ribs 101 have a corresponding offset Y pattern on the rear face 102 of the disc brush end wall 103 to provide stock surrounding the holes 116 for the tufts 115. Integrally formed at the center of the disc brush end wall 103 is a hollow hub 121 in which is locked an insert 82 of low friction material such as acetal. The insert 82 has a D-shaped bore 123 which rotationally interlocks on the shaft flat area 75 but which permits axial movement of the disc brush 13 along the shaft 71. The disc brush 13 is axially retained on the shaft 71 by the retaining washer 83. From the foregoing, it will be understood that the disc brush 13 is rotationally interlocked to the turbine wheel 15 by the shaft 71.

The rotary disc brush 13 is resiliently biased away from the stator 14 and turbine wheel 15 by the spring 81. The spring 81 is a helical compression spring sized to normally maintain the disc brush 13 in the solid line position illustrated in FIG. 5 where the disc brush tufts 115 extend forwardly of the brush ring tufts 33. An exterior surface 130 of the disc brush sidewall 108 is in telescoping relation with an interior generally cylindrical surface 131 of the stator sidewall 84.

Figure 2:
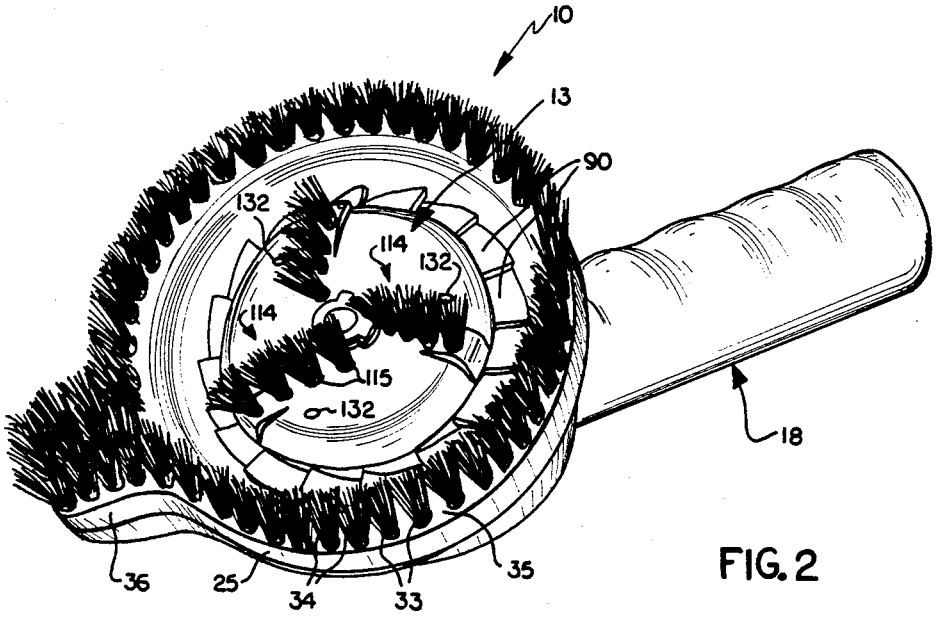
FIG. 2 is a perspective view of the lower side of the sweeper.
Figure 3:
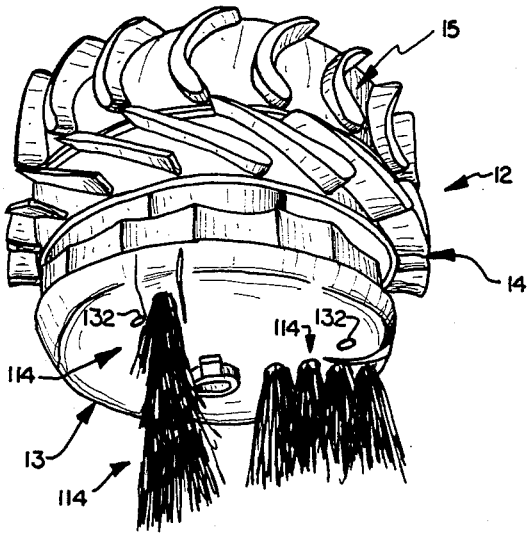
FIG. 3 is a perspective view of a disc brush, stator and turbine wheel assembly (center assembly) which operates in the housing of FIGS. 1 and 2.

Air inlet holes 132 extend through the disc brush end wall 103. In the illustrated example, the holes are three in number, each being associated with one of the rows 114 of brush tufts 115. As viewed in FIG. 2, the rotary brush 13 turns counterclockwise and, as shown, the air inlet holes 132 lead their respective tuft rows 114.

In operation, the tubular handle 18 is connected to a source of vacuum such a domestic vacuum cleaner by means of conventional flexible hose having its end fitting inserted into the interior 47. Suction applied to the housing handle interior 47 causes air to be drawn through the housing 11. The bellmouthed surface 37 of the brush ring 25 serves as the inlet for air flow through the housing 11 and the handle interior 47 serves as the outlet. Between these inlet and outlet points, the interior housing surface 38 forms the main outer peripheral boundary for such air flow. Air rushes through the annular space between this peripheral housing surface 38 and the center assembly 12. The stator blades 90 channel this air flow in a helical-like direction as it passes through the axial zone of these blades. This orientation of air flow improves the efficiency of the turbine wheel 15 in developing a high torque at relatively low speed. After the air flow transfers its momentum by the Pelton wheel effect to the turbine wheel 15, it exhausts through an opening 141 into the handle 18 from the main housing body 16.

As air impinges on the turbine wheel blades 63, the turbine wheel 15 is caused to rotate. Rotary motion of the turbine wheel 15 is imparted to the disc brush 13 permitting the latter to be used to sweep over a surface to be cleaned. At the same time, air rushing into the inlet 37 causes dirt and debris which is swept up by the bristle tufts 33, 115 or which is relatively loose to be collected at the vacuum source.

An air flow circuit for purging the hollow cavity 109 of the disc brush 13 and the hollow cavity 86 of the stator 14 is provided, in part by the air inlet holes 132 in the disc brush end wall 103. Air indicated by the arrows 151 flows into these inlet holes 132 and circulates through the respective cavities of the disc brush 13 and stator 14 and is drawn out of this hollow or cavity area through a peripheral gap 152 between the disc brush sidewall 108 and stator sidewall 84. It will be understood that the major outside diameter of the scalloped disc brush sidewall 108 is somewhat less than the minor inside diameter of the stator sidewall 84, for purposes of maintaining rotating clearance and for maintaining this purge air flow. During rotation of the disc brush 13, the scallops or irregular surface segments 129 of the outer periphery 130 of the sidewall 108 produce turbulence in the adjacent air, which develops a slight relative increase in air pressure at this point to prevent back flow of ambient air through the gap 152 into the disc brush and stator cavities. It has been found that a positive flow of ambient air through these cavity areas, entering the holes 132 and exiting through the peripheral gap 152 is effective in sweeping these cavity areas free of accumulations of dirt and debris which otherwise occur when such holes 132 and related flow circuit is not provided. As mentioned, the holes 132 each associated with a tuft row 114 leads such row during rotation, and it has been found that this relation develops the most effective positive air flow current through the disc brush and stator cavities.

The disc brush 13 is capable of floating axially with respect to the housing brush ring 25 so as to limit and otherwise control the brushing force which can be developed by the tool 10. At high brush force levels, the axial resistance of the resilient spring 81 is overcome and the disc brush 13 retracts towards the interior of the housing 11. In this mode, the disc brush insert 122 slides along the shaft 71. The retracted position of the disc brush 13 is indicated at 161 by phantom lines representing the rearward edge of the disc brush sidewall 108.

Although the preferred embodiment of this invention has been shown and described, it should be understood that various modifications and rearrangements of the parts may be resorted to without departing from the scope of the invention as disclosed and claimed herein.

What is claimed is:

1. A vacuum rotary sweeper comprising a housing having an air inlet and an air outlet, a rotary disc brush having a central axis and supported by the housing adjacent the inlet for rotation about said axis, a turbine wheel rotatably supported in the housing rearwardly of the disc brush for rotation about said axis, means rotationally coupling the disc brush to the turbine wheel, the housing having an interior peripheral surface area encircling a portion of the axial zone from the disc brush to the turbine wheel, a generally annular surface element axially inward of the disc brush and spaced radially inward of said housing interior peripheral surface, said housing interior peripheral surface and annular surface element mutually forming an annular flow passage for air passing between the inlet and outlet, a stator having a plurality of peripherally spaced blades for directing air flow to the turbine wheel in a spiral direction, a hollow cavity generally enclosed by a portion of some of said disc brush, annular surface element and turbine wheel, said disc brush being in telescoped relation with said annular surface element, and means resiliently biasing said disc brush forwardly relative to said annular surface element.

2. A vacuum driven rotary tool comprising a housing having an air inlet and an air outlet, a rotary disc having a central axis and supported by the housing adjacent the inlet for rotation about said axis, a turbine wheel rotatably supported in the housing rearwardly of the disc for rotation about said axis, means rotationally coupling the disc to the turbine wheel, the housing having an interior peripheral surface area encircling a portion of the axial zone from the disc to the turbine wheel, a generally annular surface element axially inward of the disc and spaced radially inward of said housing interior peripheral surface, said housing interior peripheral surface and annular surface element mutually forming an annular flow passage for air passing between the inlet and outlet, a hollow cavity generally enclosed by a portion of some of said disc, annular surface element and turbine wheel, said disc being in telescoped relation with said annular surface element, means resiliently biasing said disc forwardly relative to said annular surface element, and air flow purge circuit means for developing a positive flow of ambient air through the cavity and out of said outlet.

3. A tool as set forth in claim 2, wherein said resilient biasing means is disposed in said cavity.

4. A tool as set forth in claim 1, wherein said annular surface element supports a plurality of peripherally spaced stator blades, said stator blades being stationary with respect to said housing.

5. A tool as set forth in claim 4, including a stator end wall connected to said annular surface element, said end wall separating a cavity area associated with the turbine wheel and a cavity area associated with the rotary disc.

6. A tool as set forth in claim 5, wherein said coupling means comprises a rotary shaft, said end wall supporting a bearing for said rotary shaft.

7. A tool as set forth in claim 2, wherein said air flow purge circuit means includes aperture means extending through said disc and a peripheral gap between telescopic portions of said disc and annular surface element.

8. A tool as set forth in claim 7, wherein said disc has an irregular peripheral surface area which induces a localized increase in air pressure to limit inflow of air through said gap into said cavity.

* * * * *